US006691356B1

(12) United States Patent
Coma

(10) Patent No.: US 6,691,356 B1
(45) Date of Patent: Feb. 17, 2004

(54) PORTABLE CUSHION APPARATUS

(76) Inventor: Charles E. Coma, #30415-086 US Penitentary 3901 Klein Blvd., Lontoc, CA (US) 93436

( * ) Notice: Subject to any disclaimer, the term of this patent is extended or adjusted under 35 U.S.C. 154(b) by 0 days.

(21) Appl. No.: 10/159,050

(22) Filed: May 31, 2002

(51) Int. Cl.[7] ..... A47G 9/06
(52) U.S. Cl. ..... 5/722; 5/417; 5/420; 5/657
(58) Field of Search ..... 5/722, 417, 419, 5/420, 657

(56) References Cited

U.S. PATENT DOCUMENTS 4,441,271 A 4/1984 Hutchinson
4,606,087 A 8/1986 Alivizatos
4,925,241 A 5/1990 Geraci
D366,800 S 2/1996 Moore, Jr.
5,533,219 A 7/1996 Meyers
D376,287 S 12/1996 Bennett

*Primary Examiner*—Teri Pham Luu
*Assistant Examiner*—Fredrick Conley

(57) ABSTRACT

A portable cushion apparatus for positioning between a user and a support surface. The portable cushion apparatus includes a plurality of pad members each having a first portion and a second portion. Each of the pad members is movable between a folded position and an unfolded position. The plurality of pad members includes a first end pad member, A second end pad member, and a plurality of middle pad member. A flexible first coupler is attached to and extends away from a first side of the first end pad member. A flexible second coupler is attached to and extends away from a second side of the second end pad member. The first and second couplers are attached to first and second sides of the plurality of middle pad members respectively. The pad members have a plurality of handles for grasping onto by a hand of a user.

15 Claims, 3 Drawing Sheets

PORTABLE CUSHION APPARATUS

BACKGROUND OF THE INVENTION

1. Field of the Invention

The present invention relates to cushions and more particularly pertains to a new portable cushion apparatus for positioning between a user and a support surface.

2. Description of the Prior Art

The use of cushions is known in the prior art. U.S. Pat. No. 4,925,241 describes a cushion for sporting events. Another type of cushion is U.S. Pat. No. 5,553,219 having a means for attaching to a conventional stadium seat.

While these devices fulfill their respective, particular objectives and requirements, the need remains for a cushioning apparatus that may be utilized in a variety of different configurations for various applications, such as a single seat cushion, an interconnected plurality of seat cushions, a personal floor mat, or a flotation mat.

SUMMARY OF THE INVENTION

The present invention meets the needs presented above by consisting of a plurality of pad members that are interconnectable and water-resistant.

Still yet another object of the present invention is to provide a new portable cushion apparatus that is easily foldable into a transport configuration, with handles and a carrying strap.

Even still another object of the present invention is to provide a new portable cushion apparatus that is multifunctional.

To this end, the present invention generally comprises a plurality of pad members each having a first portion and a second portion. Each of the pad members is movable between a folded position and an unfolded position. The plurality of pad members includes a first end pad member. A second end pad member, and a plurality of middle pad member. A flexible first coupler is attached to and extends away from a first side of the first end pad member. A flexible second coupler is attached to and extends away from a second side of the second end pad member. The first and second couplers are attached to first and second sides of the plurality of middle pad members respectively. The pad members have a plurality of handles for grasping onto by a hand of a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
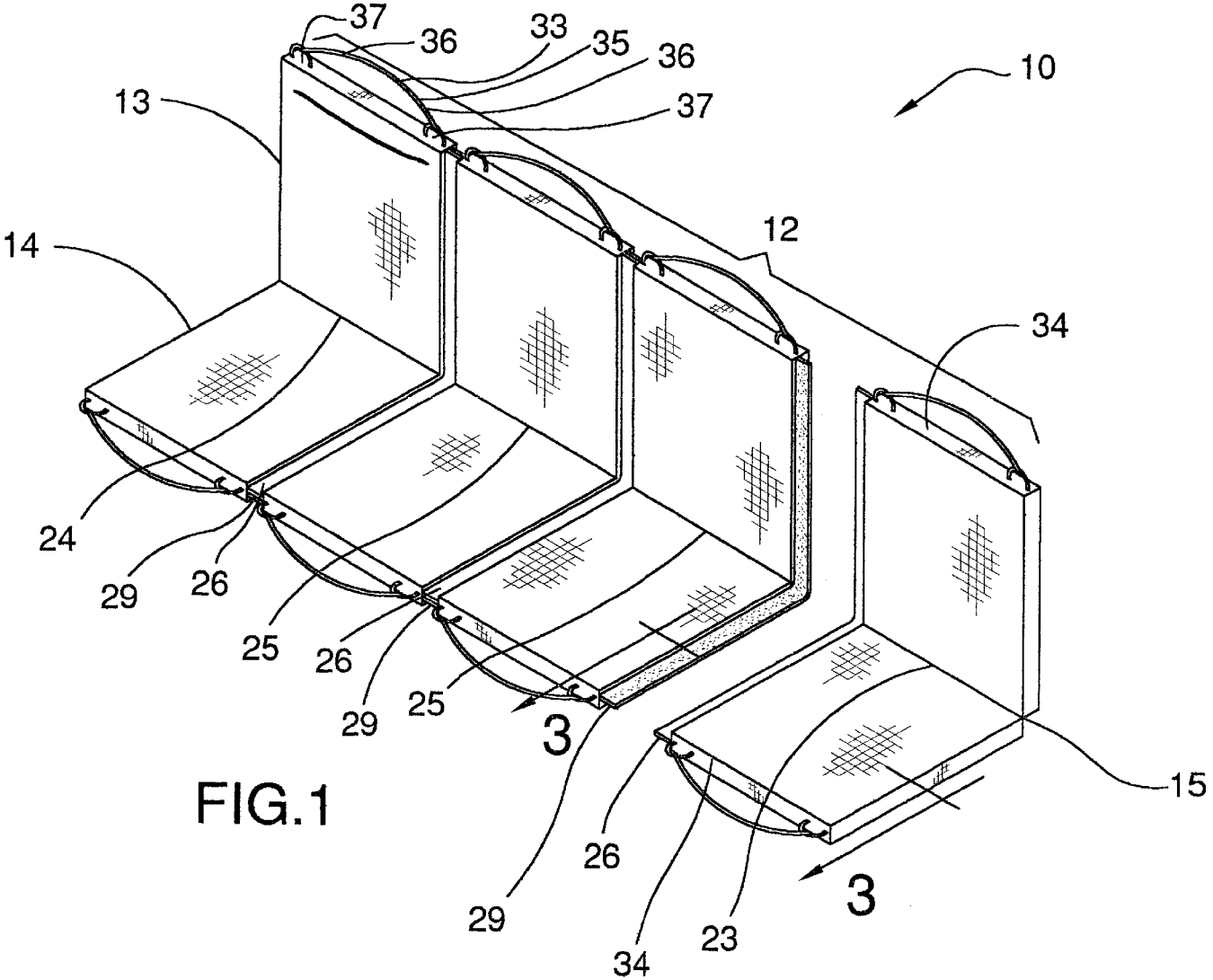
FIG. 1 is a schematic perspective view of a new portable cushion apparatus according to the present invention.
Figure 2:
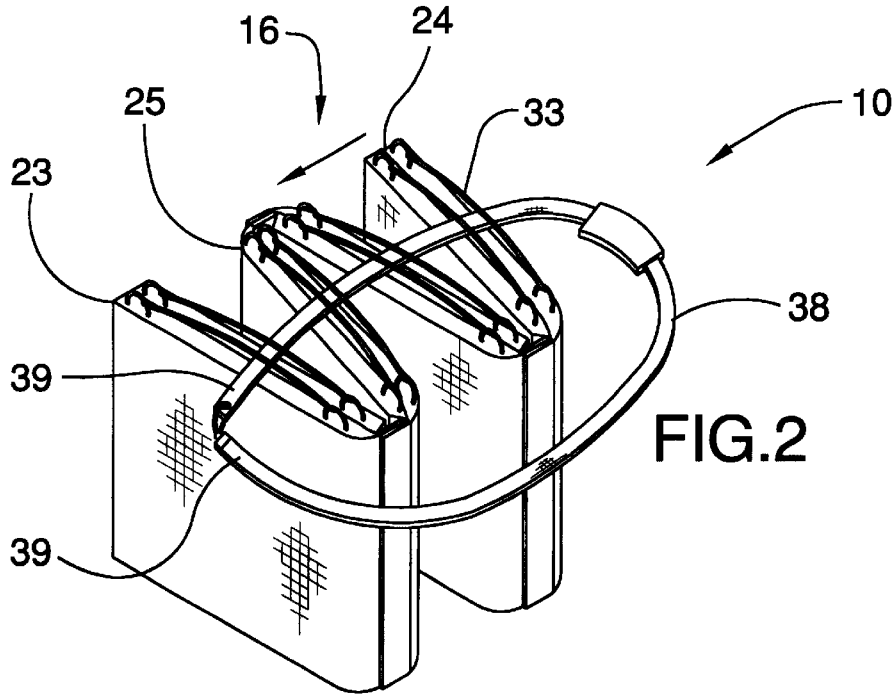
FIG. 2 is a schematic perspective view of the present invention in the folded configuration.
Figure 3:
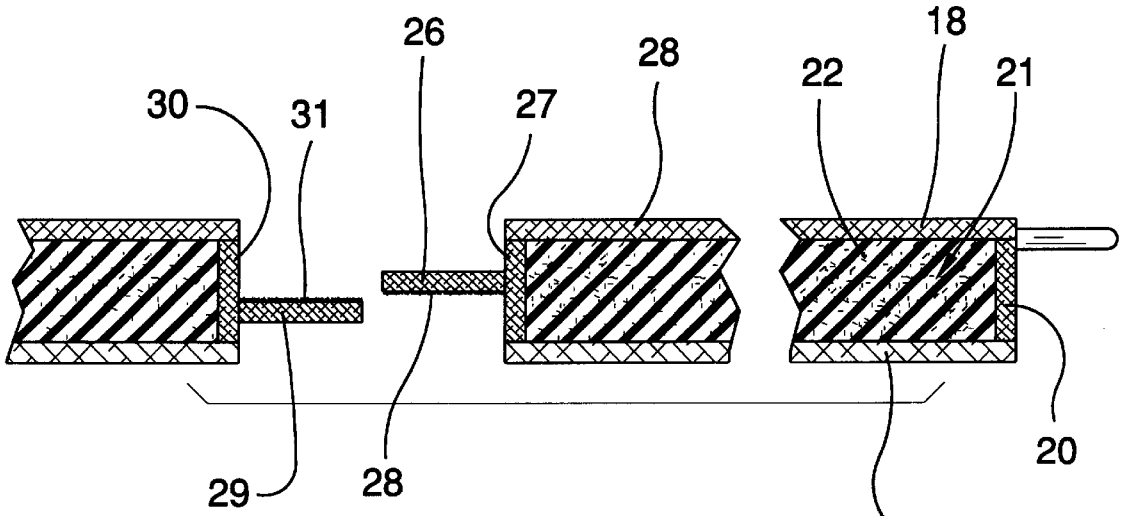
FIG. 3 is a schematic side cross-sectional view of the present invention taken along the sectional lines in FIG. 1.
Figure 4:
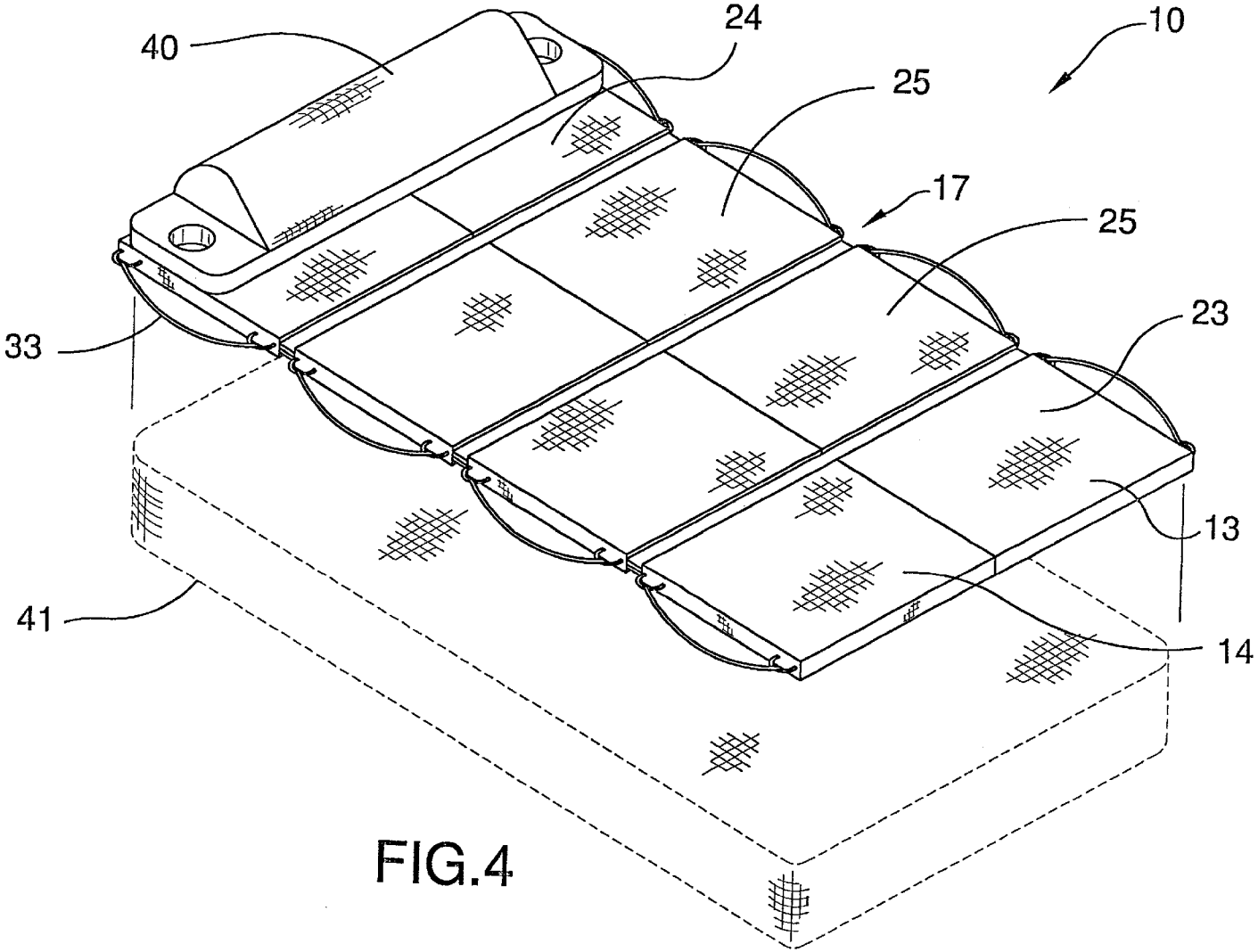
FIG. 4 is a schematic perspective view of the present invention in the unfolded configuration.

With reference now to the drawings, and in particular to FIGS. 1 through 4 thereof, a new portable cushion apparatus embodying the principles and concepts of the present invention and generally designated by the reference numeral 10 will be described.

As best illustrated in FIGS. 1 through 4, the portable cushion apparatus 10 generally comprises a plurality of pad members 12, each having a first portion 13 and a second portion 14. A shape of each of the portions 13, 14 is generally the same. Inner ends 15 of the portions 13, 14 are hingably coupled together to permit pivoting of the portions 13, 14 with respect to each other such that each of the pad members 12 is movable between a folded position 16 and an unfolded position 17.

Each of the portions 13, 14 has a top wall 18, a bottom wall 19, and a peripheral wall 20 that extends between the top wall 18 and the bottom wall 19 such that an interior 21 is defined.

The folded position 16 is characterized by the top walls 18 of the portions 13, 14 abutting, and the unfolded position 16 is characterized by the top walls 18 of the portions 13, 14 lying in a common plane.

A cushion 22 of each of the portions 13, 14 is positioned in the interior 21 of each of the portions 13, 14. The cushion 22 comprises a resiliently buoyant material such that each of the pad members 12 is substantially buoyant. Each of the walls 18, 19, 20 of the portions 13, 14 comprises a fluid impervious flexible material such that each of the cushions 22 is protected from moisture.

The plurality of pad members 12 includes a first end pad member 23, a second end pad member 24, and at least one middle pad member 25.

A flexible first coupler 26 is attached to and extends away from a first side 27 of the first end pad member 23. The first coupler 26 is positioned on the peripheral wall 20 of the first end pad member 23 and is oriented generally perpendicular to the peripheral wall 20. The first coupler 26 comprises a first hook and loop fastener 28.

A flexible second coupler 29 is attached to and extends away from a second side 30 of the second end pad member 24. The second coupler 29 is positioned on the peripheral wall 20 of the second end pad member 24 and is oriented generally perpendicular to the peripheral wall 20. The second coupler 29 comprises a second hook and loop fastener 31.

The couplers 26, 29 are selectable from the group consisting of hook and loop fasteners, snaps, and zippers.

The first and second couplers 26, 29 are attached to first and second sides 30 of the middle pad members 25 respectively such that each of the middle pad members 25 are selectively couplable to each other, and the first and second end pad members 23, 24 are selectively couplable to the middle pad members 25.

A plurality of handles 33 for grasping onto by a hand of a user. One each of the handles 33 is positioned on opposing ends 34 of each of the pad members 12. Each of the handles 33 comprises an elongate flexible member 35 has ends 36 coupled to outer corners 37 of the opposing ends 34 of the pad members 12.

In the folded position 16, each of the handles 33 of the opposing ends 34 are positioned adjacent to each other such that grasping each of the handles 33 together holds the portions 13, 14 of each of the pad members 12 in the folded position 16.

Included is a strap 38 for carrying the pad members 12. Free ends 39 of the strap 38 is selectively couplable to each other such that the strap 38 is positionable between the opposing ends 34 and the handles 33 of each of the pad members 12 when each of the pad members 12 are coupled together and in the folded position 16.

Included is a pillow member 40 for resting a head of the user on. The pillow member 40 has a width generally equal to a distance between the opposing ends 34 of one of the pad members 12 when the pad member is in the unfolded position 16. The pillow member 40 is positionable on one of the end pad members 12.

The user may utilize the plurality of pad members 12 as a body mat when each of the pad members 12 are coupled together and in the unfolded position 16.

The user may utilize the plurality of pad members 12 as a floatation mat either alone or in conjunction with an air mattress 41 when each of the pad members 12 are coupled together and in the unfolded position 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A portable cushion apparatus for positioning between a user and a support surface, said apparatus comprising:

a plurality of pad members each having a first portion and a second portion;

each of said pad members being movable between a folded position and an unfolded position;

said plurality of pad members including a first end pad member a second end pad member, and at least one middle pad member;

a flexible first coupler being attached to and extending away from a first side of said first end pad member;

a flexible second coupler being attached to and extending away from a second side of said second end pad member;

said first and second couplers being attached to first and second sides of said plurality of middle pad members respectively;

a plurality of handles for grasping onto by a hand of a user;

a strap for carrying said pad members;

a pillow member for resting a head of the user on; and one each of said handles being positioned on opposing ends of each of said pad members such that one of said handles is positioned on said first portion of each of said pad members and one of said handles is positioned on said second portion of said pad members, said handles positioned on said first portion of each of said pad members being aligned when said pad members are unfolded, said handles positioned on said second portion of each of said pad members being aligned when said pad members are unfolded.

2. The portable cushion apparatus as set forth in claim 1, further comprising a shape of each of said portions being generally the same, inner ends of said portions being hingably coupled together to permit pivoting of said portions with respect to each other.

3. The portable cushion apparatus as set forth in claim 1, further comprising each of said portions having a top wall, a bottom wall, and a peripheral wall extending between said top wall and said bottom wall such that an interior is defined.

4. The portable cushion apparatus as set forth in claim 3, wherein said folded position is characterized by said top walls of said portions abutting, and said unfolded position is characterized by said top walls of said portions lying in a common plane, a cushion of each of said portions being positioned in said interior of each of said portions each of said cushions being substantially waterproof.

5. The portable cushion apparatus as set forth in claim 4, further comprising said cushion comprising a resiliently buoyant material such that each of said pad members is substantially buoyant, each of said walls of said portions being substantially waterproof.

6. The portable cushion apparatus as set forth in claim 3, further comprising said first coupler being positioned on said peripheral wall of said first pad member and being oriented generally perpendicular to said peripheral wall, said first coupler comprising a first hook and loop fastener.

7. The portable cushion apparatus as set forth in claim 3, further comprising said second coupler being positioned on said peripheral wall of said second pad member and being oriented generally perpendicular to said peripheral wall, said second coupler comprising a second hook and loop fastener.

8. The portable cushion apparatus as set forth in claim 1, wherein each of said middle pad members are selectively couplable to each other and said first and second end pad members are selectively couplable to said middle pad members.

9. The portable cushion apparatus as set forth in claim 1, further comprising each of said handles comprising an elongate flexible member having ends coupled to outer corners of said opposing ends of said pad members.

10. The portable cushion apparatus as set forth in claim 1, wherein in said folded position, each of said handles of said opposing ends being positioned adjacent to each other such that grasping each of said handles together holds said portions of each of said pad members in said folded position.

11. The portable cushion apparatus as set forth in claim 1, further comprising free ends of said strap being selectively couplable to each other such that said strap is positionable between said opposing ends and said handles of each of said pad members when each of said pad members are coupled together and in said folded position.

12. The portable cushion apparatus as set forth in claim 1, further comprising said pillow member having a width generally equal to a distance between said opposing ends of one of said pad members when said pad member is in said unfolded position said pillow member being positionable on one of said end pad members.

13. The portable cushion apparatus as set forth in claim 1, further comprising wherein the user may utilize said plurality of pad members as a body mat when each of said pad members are coupled together and in said unfolded position.

14. The portable cushion apparatus as set forth in claim 1, wherein the user may utilize said plurality of pad members as a floatation mat either alone or in conjunction with an air mattress when each of said pad members are coupled together and in said unfolded position.

15. A portable cushion apparatus for positioning between a user and a support surface, said apparatus comprising:

a plurality of pad members each having a first portion and a second portion, a shape of each of said portions being generally the same, inner ends of said portions being hingably coupled together to permit pivoting of said portions with respect to each other such that each of said pad members is movable between a folded position and an unfolded position, each of said portions having a top wall, a bottom wall, and a peripheral wall extending between said top wall and said bottom wall such that an interior is defined, wherein said folded position is characterized by said top walls of said portions abutting and said unfolded position is characterized by said top walls of said portions lying in a common plane, a cushion of each of said portions being positioned in said interior of each of said portions, each of said cushions being substantially waterproof, each of said cushions comprising a resiliently buoyant material such that each of said pad members is substantially buoyant, each of said walls of said portions being substantially waterproof;

wherein said plurality of pad members includes a first end pad member, a second end pad member, and at least one middle pad member;

a flexible first coupler being attached to and extending away from a first side of said first end pad member, said first coupler being positioned on said peripheral wall of said first pad member and being oriented generally perpendicular to said peripheral wall, said first coupler comprising a first hook and loop fastener;

a flexible second coupler being attached to and extending away from a second side of said second end pad member, said second coupler being positioned on said peripheral wall of said second pad member and being oriented generally perpendicular to said peripheral wall, said second coupler comprising a second hook and loop fastener;

wherein said first and second couplers are attached to first and second sides of said plurality of middle pad members of said plurality of pad members respectively such that each of said middle pad members are selectively couplable to each other and said first and second end pad members are selectively couplable to said middle pad members;

a plurality of handles for grasping onto by a hand of a user, one each of said handles being positioned on opposing ends of each of said pad members such that one of said handles is positioned on said first portion of each of said pad members and one of said handles is positioned on said second portion of said pad members, said handles positioned on said first portion of each of said pad members being aligned when said pad members are unfolded, said handles positioned on said second portion of each of said pad members being aligned when said pad members are unfolded, each of said handles comprising an elongate flexible member having ends coupled to outer corners of said opposing ends of said pad members;

wherein in said folded position, each of said handles of said opposing ends being positioned adjacent to each other such that grasping each of said handles together holds said portions of each of said pad members in said folded position;

a strap for carrying said pad members, free ends of said strap being selectively couplable to each other such that said strap is positionable between said opposing ends and said handles of each of said pad members when each of said pad members are coupled together and in said folded position;

a pillow member for resting a head of the user on, said pillow member having a width generally equal to a distance between said opposing ends of one of said pad members when said pad member is in said unfolded position, said pillow member being positionable on one of said end pad members;

wherein the user may utilize said plurality of pad members as a body mat when each of said pad members are coupled together and in said unfolded position; and wherein the user may utilize said plurality of pad members as a floatation mat either alone or in conjunction with an air mattress when each of said pad members are coupled together and in said unfolded position.

* * * * *